US009039121B2

(12) United States Patent
Sudo et al.

(10) Patent No.: US 9,039,121 B2
(45) Date of Patent: May 26, 2015

(54) PRINTING DEVICE AND PRINTING METHOD

(71) Applicant: SEIKO EPSON CORPORATION, Tokyo (JP)

(72) Inventors: Naoki Sudo, Nagano (JP); Bunji Ishimoto, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/204,266

(22) Filed: Mar. 11, 2014

(65) Prior Publication Data

US 2014/0292866 A1 Oct. 2, 2014

(30) Foreign Application Priority Data

Mar. 28, 2013 (JP) ..... 2013-069059

(51) Int. Cl.
*B41J 2/07* (2006.01)
*B41J 2/175* (2006.01)
*B41J 19/14* (2006.01)

(52) U.S. Cl.
CPC ..... *B41J 2/07* (2013.01); *B41J 2/17566* (2013.01); *B41J 19/142* (2013.01)

(58) Field of Classification Search
CPC ..... B41J 2/07; B41J 2/0458; B41J 2/04563; B41J 29/393; B41J 2/04591; B41J 2/04581
See application file for complete search history.

(56) References Cited

U.S. PATENT DOCUMENTS

2009/0284559 A1* 11/2009 Sudo et al. ..... 347/14
2011/0261099 A1* 10/2011 Miyashita et al. ..... 347/12

FOREIGN PATENT DOCUMENTS

JP 2006-326939 A 12/2006

* cited by examiner

*Primary Examiner* — Manish S Shah
*Assistant Examiner* — Jeremy Delozier
(74) *Attorney, Agent, or Firm* — Global IP Counselors, LLP

(57) ABSTRACT

A printing device includes a required ink amount acquisition part, an ejectable amount acquisition part, and a division printing control part. The required ink amount acquisition part is configured to determine a required ink amount based on print data of a bandwidth over which ink is ejected by driving an ink head in a main scanning direction. The ejectable amount acquisition part is configured to determine an ejectable amount based on a residual amount in an ink cartridge. The division printing control part is configured to determine whether a printing for the bandwidth is performed by one time of a main scanning operation, or the printing is performed by dividing into multiple main scanning operations based on the required ink amount and the ejectable amount, and to perform the printing in accordance with the determination.

8 Claims, 8 Drawing Sheets

PRINTING DEVICE AND PRINTING METHOD

CROSS-REFERENCE TO RELATED APPLICATIONS

This application claims priority to Japanese Patent Application No. 2013-069059 filed on Mar. 28, 2013. The entire disclosure of Japanese Patent Application No. 2013-069059 is hereby incorporated herein by reference.

BACKGROUND

1. Technical Field

The present invention relates to a printing device and a printing method using a print head to eject ink supplied from an ink cartridge for printing.

2. Related Art

In the printing device supplying ink from an ink cartridge to a print head, a printing control is performed with the consideration of a residual ink amount.

As described in Japanese Laid-open Patent Publication No. 2006-326939, when the residual ink amount becomes lower than a threshold value, the ink flow rate is reduced by increasing the number of multipasses.

SUMMARY

Originally, even though the residual ink amount was reduced, it may be printable without reducing the ink flow rate depending on a print condition. However, according to the aforementioned conventional method, when the residual ink amount is reduced, the number of multipasses is always increased so that the printing is unnecessarily performed by the multipasses so that it possibly increases the printing time.

An object of the present invention is to print without taking time more than necessary.

A printing device according to one aspect has a print head configured and arranged to eject ink supplied from an ink cartridge, the print head being reciprocally drivable in a main scanning direction, which intersects a paper feed direction, with respect to a print medium, and the print medium being sequentially drivable in a sub-scanning direction, which is the paper feed direction. The printing device includes a required ink amount acquisition part, an ejectable amount acquisition part, and a division printing control part. The required ink amount acquisition part is configured to determine a required ink amount based on print data of a bandwidth over which the ink is ejected by driving the ink head in the main scanning direction. The ejectable amount acquisition part is configured to determine an ejectable amount based on a residual amount in the ink cartridge. The division printing control part is configured to determine whether a printing for the bandwidth is performed by one time of a main scanning operation, or the printing is performed by dividing into multiple main scanning operations based on the required ink amount and the ejectable amount, and to perform the printing in accordance with the determination.

In the aforementioned configuration, when the required ink amount acquisition part determines the required ink amount based on the print data of the bandwidth over which the ink is ejected by driving the print head in the main scanning direction, the ejectable amount acquisition part determines the ejectable amount based on the residual amount of the ink cartridge so that the division printing control part determines whether the printing for the bandwidth is performed by one time of the main scanning operation or by dividing into multiple main scanning operations based on the aforementioned required ink amount and the aforementioned ejectable amount. For example, the printing is not performed by dividing it daringly as long as the required ink amount does not exceed the ejectable amount. However, when the required ink amount exceeds the ejectable amount, there is a possibility that the supply of ink may not be enough. Therefore, the printing for the aforementioned bandwidth is performed in accordance with the aforementioned determination based on the result of comparison.

According to the printing device and the printing method of the present invention, when the residual ink amount is reduced, the division printing is not always performed and the division printing is performed only when that is necessary.

BRIEF DESCRIPTION OF THE DRAWINGS

Referring now to the attached drawings which form a part of this original disclosure.

DETAILED DESCRIPTION OF EXEMPLARY EMBODIMENTS

Hereinafter, the embodiment of the present invention will be described in reference to the drawings.

Figure 1:
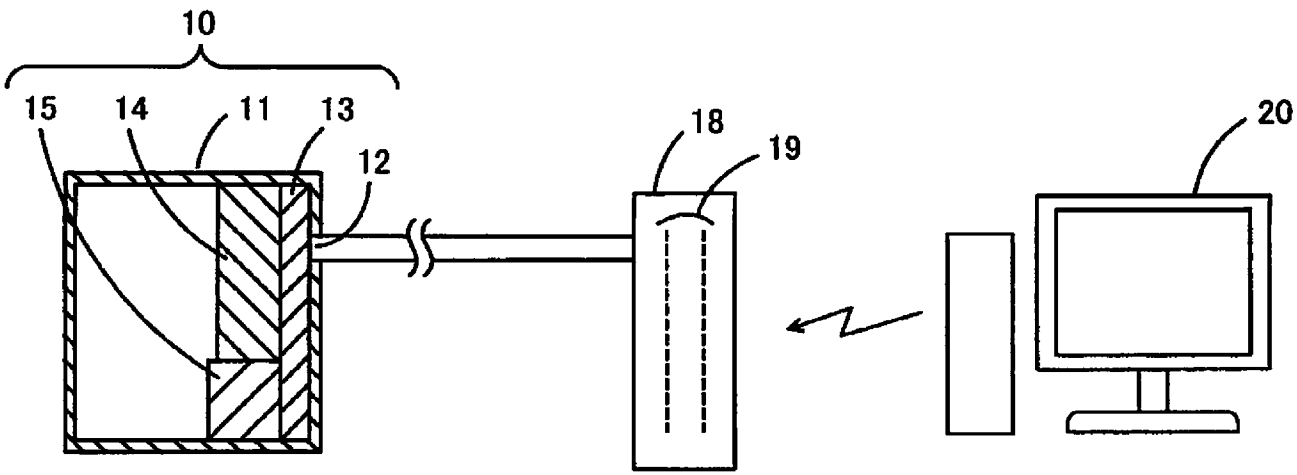
FIG. 1 is a diagram showing an ink passage from an ink cartridge, in which an ink processing of the present invention is applied, to an ink head.

FIG. 1 shows an ink passage from an ink cartridge, in which an ink processing of the present invention is applied, to an ink head.

In the same drawing, an approximately sealed container 11 as a housing, a first foam 13, which is high density, arranged to cover vicinity of a supply port 12 inside the approximately sealed container 11, a second foam 14, which is lower density, arranged more inside than the first foam 13, and a third foam 15, which is lower density, contacting with the first foam 13 and the second foam 14 in a part farther than the supply port 12 are accommodated in the ink cartridge 10.

The ink is steadily supplied to an ink head 18 by mounting the first to third foams 13 to 15.

One or plural numbers of nozzle arrays 19 are formed in a paper feed direction in the print head 18. The ink is ejected from each nozzle, which configures the nozzle array 19, while the print head 18 is reciprocally driven in the main scanning direction, which is the width direction of the print medium so that it is possible to perform a predetermined printing on the print medium. By the way, a width that can be printed by ejecting ink from the nozzle array 19 at one main scanning is called as a bandwidth. The print head 18 that is linearly driven in the main scanning direction is called as a main scanning operation. Each of the main scanning operations is called as a pass. When the printing of one bandwidth was completed through one or plural numbers of passes, the print medium is successively driven so as to perform the paper feeding. The paper feed direction is called as a sub-scanning direction. The sub-scanning direction and the main scanning direction are approximately orthogonal each other (intersecting each other).

Next, the printing device equipped with the aforementioned print head 18 obtains raster data for a print from a PC, etc. and performs printing.

Figure 2:
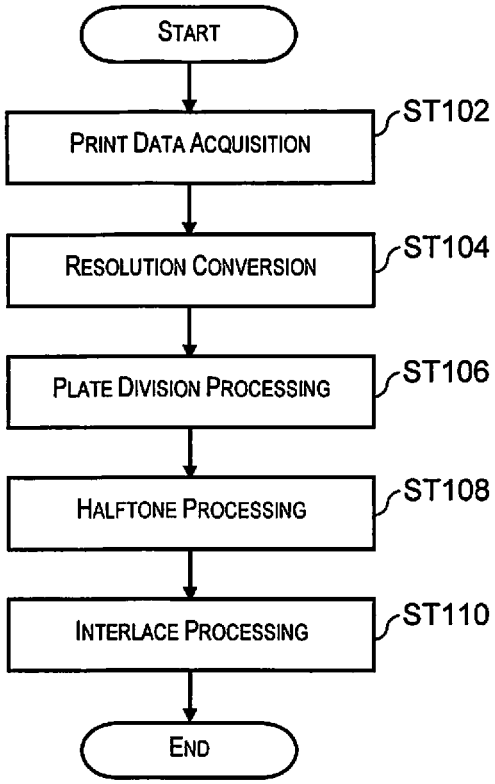
FIG. 2 is a flowchart showing a flow of the processing of the present invention.

FIG. 2 is a flowchart showing the flow of the process that generates raster data from print data on the PC side.

The PC 20 obtains input image data in Step ST102 and performs a resolution conversion corresponding to a resolution of an inkjet printer as the printing device in Step ST104. Next, in Step ST106, the PC 20 performs a plate division processing to the CMYK (cyan, magenta, yellow, black) corresponding to the ink colors from the RGB (red, green, blue) data. In the plate division processing, the print data of the CMYK, which was optimized in each print medium, is generated. At the point dividing into each color, it is multi-gradation data so that in Step ST108, a halftone processing is performed to be a bit value corresponding to a dot diameter in the case of binary or multi-dot size.

Next, the halftone result is binary bitmap data, etc. corresponding to the resolution of the printing device so that it is not specifically the optimization to drive the nozzle array 19 of the same print head 18 while driving the print head 18 in the main scanning direction. Because of this, in Step ST110, in consideration of timing for the paper feed or timing for driving the print head, the raster data for ejecting ink by controlling the nozzle array 19 in each pass is generated. This process is called as an interlace processing.

As described above, there is a tendency that the residual ink amount in the ink cartridge 10 affects when supplying the ink to the nozzle array 19 of the print head 18 from the ink cartridge 10.

Figure 3:
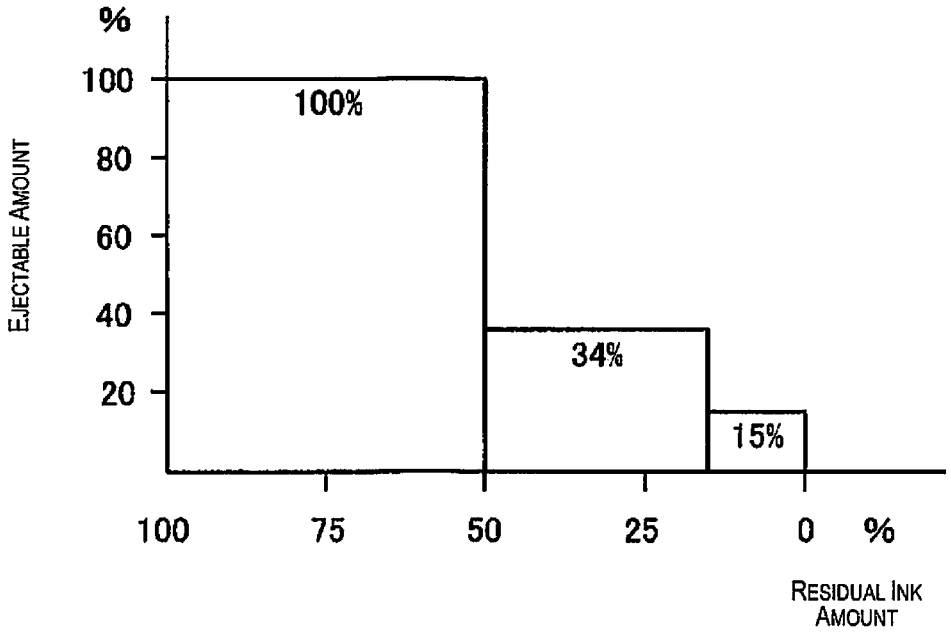
FIG. 3 is a graph showing a correspondence between a residual ink amount and an ejectable amount.

FIG. 3 is a graph showing a correspondence between a residual ink amount and an ejectable amount.

In this graph, in the horizontal axis, the residual ink amount compared with an initial value is shown by the percentage "%". Also, the vertical axis indicates an ejectable amount capable of supplying without generating ink shortage in the case of ejecting in the print head 18. The ejectable amount for the maximum required ink amount when the print head 18 fills one bandwidth with large dots by using all nozzles is shown by percentage "%". For example, the ejectable amount is 100% when the residual ink amount is between 100% to 50% so that it is possible to supply all of maximum required ink amount, and in other words, it does not generate the shortage in the ink flow rate. However, when the residual ink amount becomes less than or equal to 50% and the range around approximately 10%, it becomes 34%. That is, the supply may be only 34% for the maximum required ink amount for filling it in solid so that if no countermeasures are taken, the perfect printing cannot be performed due to the ink shortage. After that, when the residual ink amount is further reduced, the ejectable amount becomes 15%.

In the present embodiment, the maximum ink amount capable of supplying in one pass is shown, but this is an example of the ejectable amount because it cannot exceed to supply this. Also, the meaning of the ejectable amount is not only total amount for one pass, and it may be an ink amount that is available supplies per unit time. Further, in this example, the residual ink amount in every certain range corresponds to the restricted ejection amount in the step-by-step manner so that it is stored as, that is, tabular data. However, the ejectable amount may be calculated by setting a predetermined function and computing based on the value of the residual ink amount.

Figure 4:
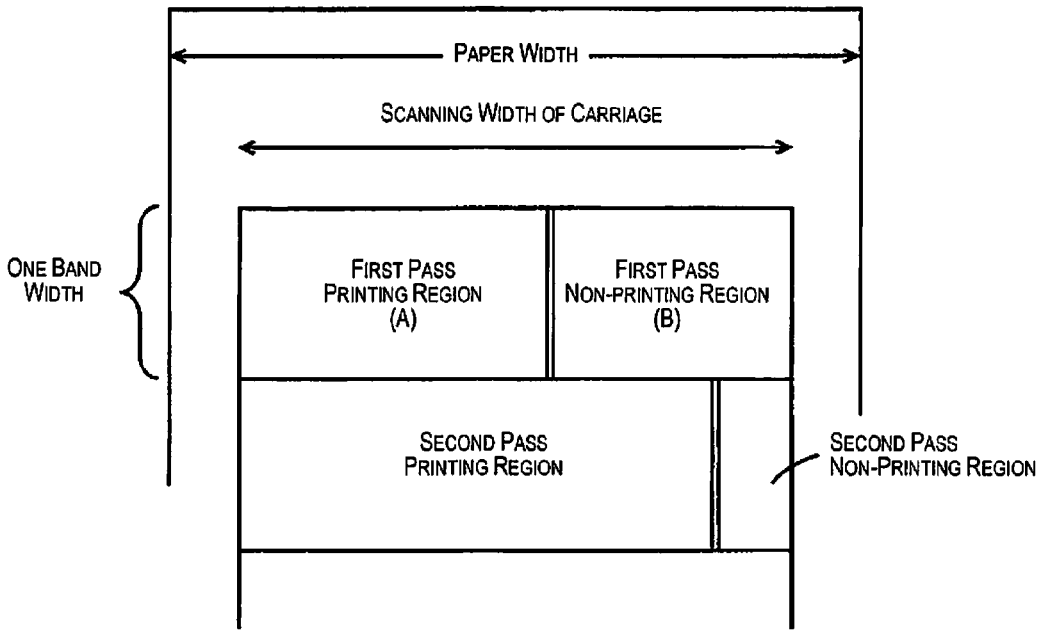
FIG. 4 is an explanatory diagram determining required ink amount.

Next, FIG. 4 is an explanatory diagram determining required ink amount to perform printing more efficiently. Not only a printing region (A) where the ink is ejected from the nozzle array 19 of the print head 18, but also a non-printing region (B) where the ink is not ejected from the nozzle array 19 is arranged in the first pass. For example, there is a case that the print head 18 only moves the printing region. This method is called as "logical seek" to scan to a print start portion for the next pass. In this case, the required ink amount is determined in the total areas of the printing region and the non-printing region of FIG. 4. Accordingly, it is less than the required ink amount of the original printing region (A). When the required ink amount is reduced, the number of passes per printing region is reduced so that the printing can be performed more efficiently.

When the restricted ejection amount and the required ejection amount were obtained, the necessary number of dividing times (number of passes) was roughly determined. However, several different types of the division methods are possible, and in the present embodiment, a division in the sub-scanning direction and a division in the main scanning direction will be described.

Figure 5:
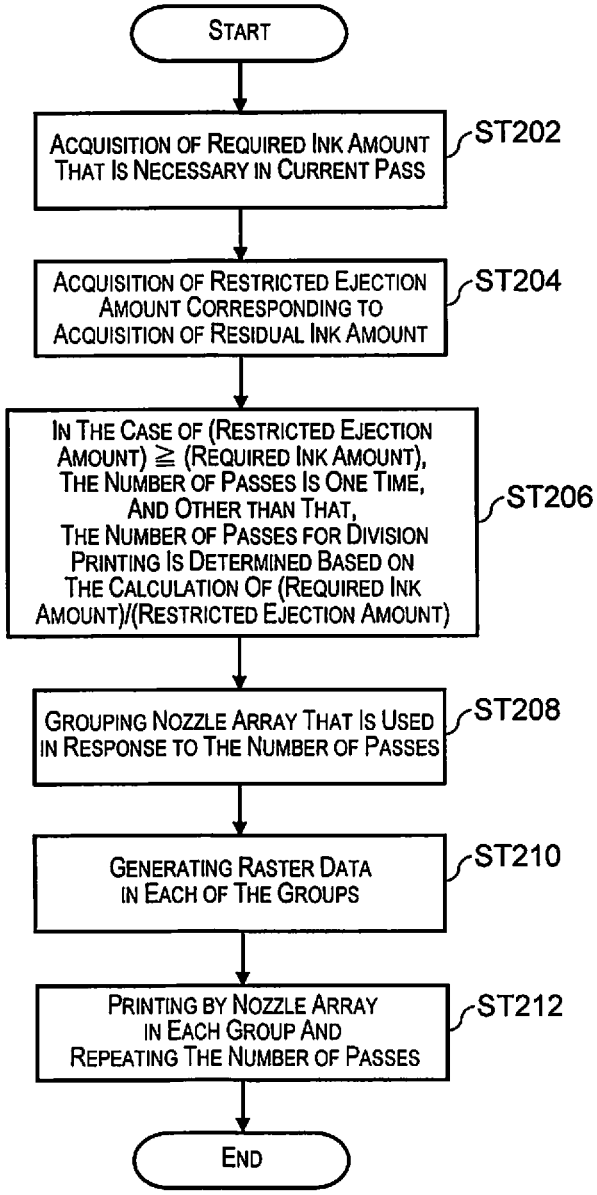
FIG. 5 is a flowchart showing a processing of a division printing in a sub-scanning direction.

FIG. 5 is a flowchart showing a processing of the division printing in the sub-scanning direction.

In Step ST202, the required ink amount that is necessary in these current passes for printing is acquired. In the current passes, in other words, in the standby state of the print head 18 after the paper feed, the raster data for a printing area having a bandwidth to be printed by the print head 18 and being printable by the print head 18 in one main scanning in the main scanning direction has been already generated in Step ST110. Accordingly, in reference to the raster data, in the printing area for one bandwidth, the required amount of ink calculated as large dots can be determined. Therefore, Step ST202 corresponds to the required ink amount acquisition part.

Next, in Step ST204, the residual ink amount of the ink cartridge 10 is determined, and the corresponding restriction and output are acquired from the tabular data shown in FIG. 3. To determine the residual ink amount, it can be realized by accumulating the ink amount of the most recent ink cartridge 10 from the post-replacement to the present and subtracting it from the original ink amount. Obviously, the actual ink amount may be determined by a sensor provided in the ink cartridge 10. For the restricted ejection amount corresponding to the residual ink amount, not only the method in reference to the table as shown in FIG. 3, but also it can be possible to realize the determination in the method for computing based on the value of the residual ink amount as described above. Accordingly, Step ST204 corresponds to the ejectable amount acquisition part.

When the restricted ejection amount and the required ink amount were determined, it determines whether the restricted ejection amount is more than the required ink amount in Step ST206. When the restricted ejection amount is larger, it is not required to perform division printing so that the number of passes is one time. However, when it is other than that, it is required to complete the required ink amount by repeating within the range of the restricted ejection amount. That is, the number of passes is computed based on the calculation of (required ink amount)/(restricted ejection amount). However, the number of passes is limited to an integer number so that an integer value where the fractional amount is round up to one decimal place is determined. For example, even when it is 1.1, the number of passes becomes "2 times" by rounding up the fractional amount to one decimal place. That is, when the calculation of (required ink amount)/(restricted ejection amount) is less than 1, it determines the printing for the bandwidth is performed in one time of the main scanning operation, and when it is more than 1, it determines that the printing is performed by dividing into multiple main scanning operations. Obviously, the threshold value is not necessary to be exactly 1, and it may be slightly changed in the present invention.

This determination corresponds to determine whether the printing for the bandwidth is performed in one time of the main scanning operation or the printing is performed by dividing into multiple main scanning operations based on the required ink amount and the ejectable amount. And, as described later, the printing for the aforementioned bandwidth is performed in accordance with this determination. More specifically, the amount to be able to eject the aforementioned ink in one time of the main scanning operation is determined as the ejectable amount (restricted ejection amount) based on the residual amount of the aforementioned ink cartridge (ejectable amount acquisition part), and when the required ink amount exceeds the ejectable amount (restricted ejection amount) in one time of the main scanning operation, it corresponds that the printing for the aforementioned bandwidth is performed by dividing into multiple main scanning operations (division printing control part).

When the number of passes was determined, the nozzle array 19 that is used in response to the number of passes is grouped in Step ST208.

Figure 6:
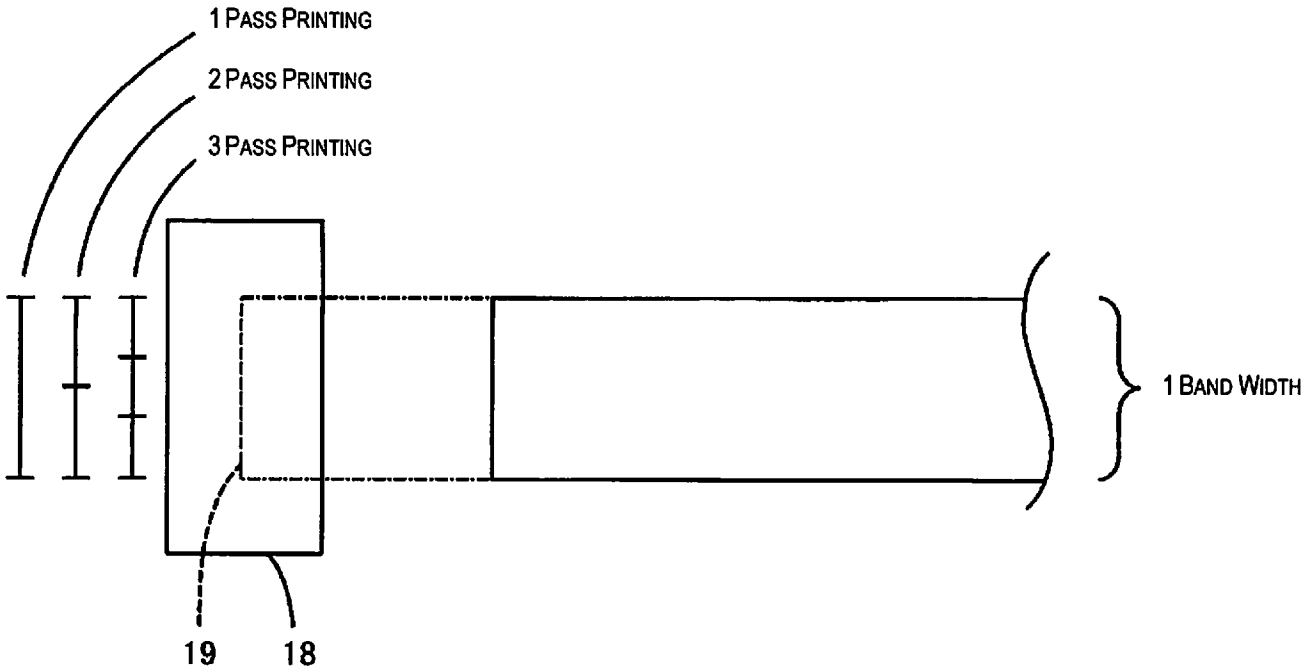
FIG. 6 is an explanatory diagram showing the division in the sub-scanning direction.

FIG. 6 shows the correspondence of grouping the nozzle array in accordance with the number of passes.

When the number of passes is one time, all part of the nozzle array 19 is used at one time. When the number of passes is two times, the nozzle array 19 is divided into two groups in the sub-scanning direction. Also, when the number of passes is three times, it is divided into three groups in the same manner. And, in Step ST210, the raster data in each group is generated based on the raster data that has been already generated. For example, when it is divided into two times, at the first time, the upper half of the nozzle array 19 is used so that the part of the raster data corresponding to the nozzle array keeps turning on, and the part of data corresponding to the non-used nozzle array is all turned off. Further, at the second time, the lower half of the nozzle array 19 is used so that the part of the raster data corresponding to the nozzle array keeps turning on, and the part of the data corresponding to the non-used nozzle array is all turned off. As a result, two raster data for two passes are generated for one printing area. At the end, in Step ST212, it is repeated as many as the number of passes so that the nozzle array of the print head 18 is driven based on the raster data corresponding to the respective passes and the printing is performed.

Accordingly, dividing groups corresponds to the meaning of that the nozzle array of the print head 18 is divided in the sub-scanning direction in response to the number of the required main scanning operations. It is repeated as many as the number of passes, and the nozzle array of the print head 18 is driven based on the raster data corresponding to the respective passes, and it corresponds to the meaning of that each division of the nozzle array is used in the respective main scanning operations. Also, the printing is performed by dividing into the groups, and it corresponds to the meaning of that the nozzle array 19 of the print head 18 is divided and used in each of the plural numbers of main scanning operations.

As described above, Step ST206 to Step ST212 corresponds to the division printing control part.

In the present embodiment, when grouping the nozzle array 19 in the sub-scanning direction, the grouping that continues in the sub-scanning direction as the upper half and the lower half is performed, but various methods are applicable in the standard of grouping. For example, when the number of passes is two times and the nozzle array 19 has two arrays arranged in zigzag, each array may be respectively assigned to two times of passes. Further, when it is two times, each nozzle in the nozzle array may be divided into two groups by skipping one, or when it is three times, each nozzle in the nozzle array may be divided into three groups by skipping two.

Figure 7:
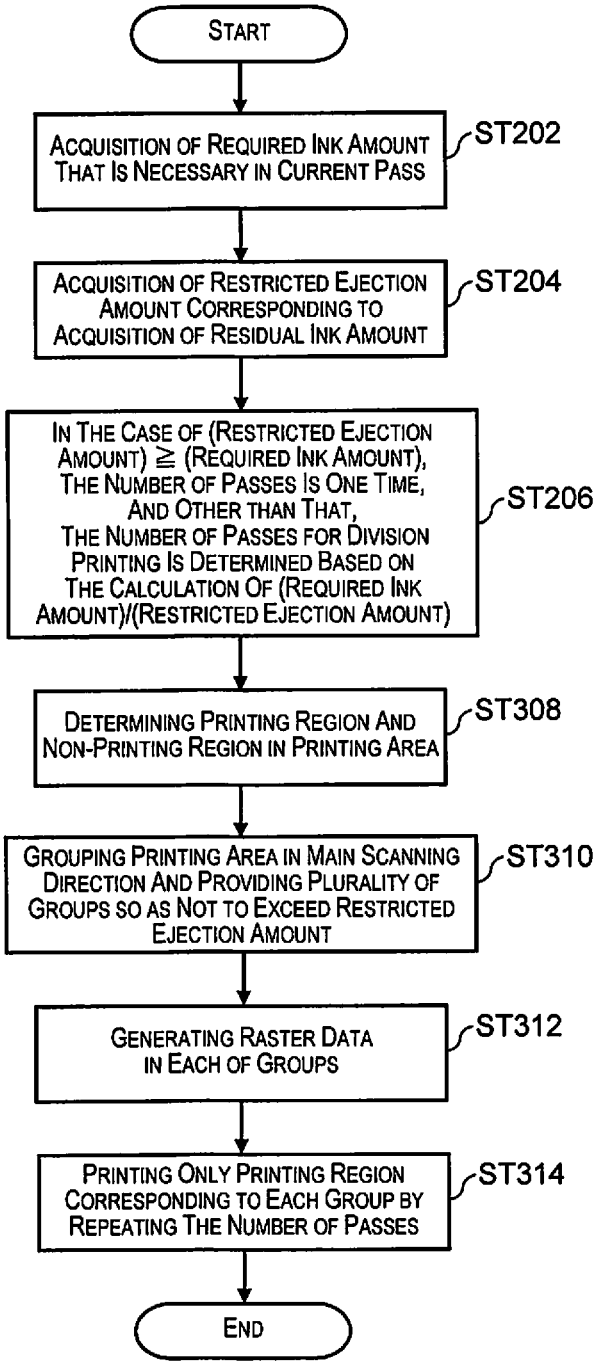
FIG. 7 is a flowchart showing a processing of a division printing in a main scanning direction.
Figure 8:
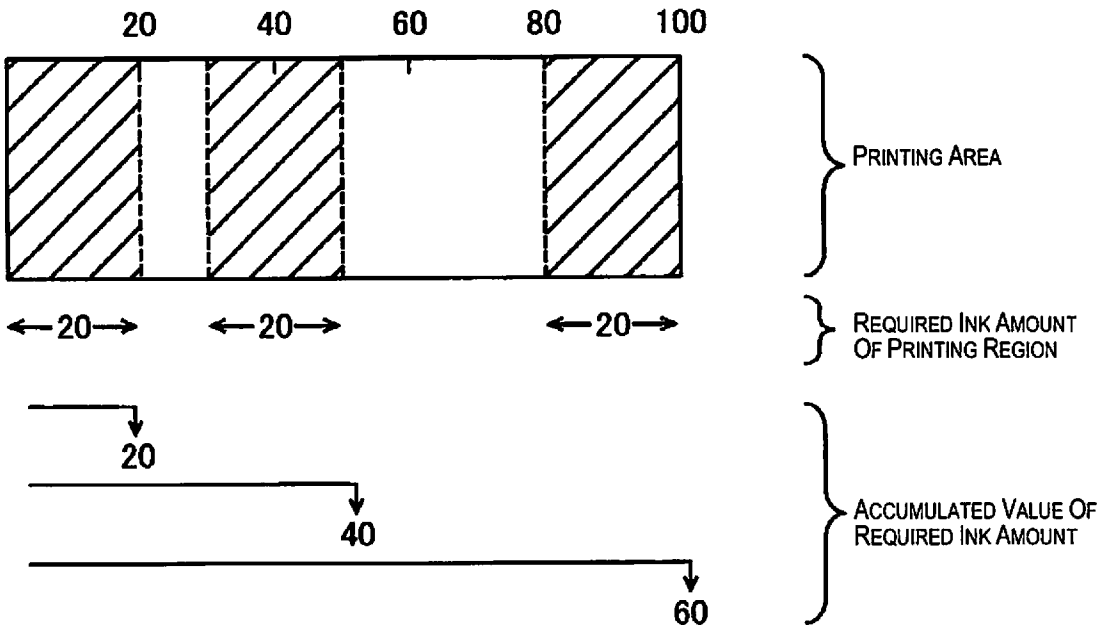
FIG. 8 is an explanatory diagram showing the division in the main scanning direction.

Next, FIG. 7 is a flowchart showing the process of the division printing in the main scanning direction, and FIG. 8 is the explanatory diagram of the process.

The meaning of the division printing in the main scanning direction is to perform printing by repeatedly reciprocating it for the plural numbers of passes in the main scanning direction in the aforementioned printing area. The process determining the number of passes is the same as the division printing in the sub-scanning direction, and it is totally the same process so that the description of Step ST202 to Steps ST206 is omitted.

In Step ST308, the determination of a printing region and a non-printing region in the printing area is performed. As described above, the raster data corresponding to this printing area has already been generated so that the same raster data is scanned from one end in the main scanning direction, and it determines whether or not there is an area where the ink is not ejected in the whole area of one bandwidth toward the sub-scanning direction. When there is such area, it is the non-printing region. When there is the non-printing region, the plurality of printing regions sandwiching this non-printing region is temporary the minimum unit of the group.

However, as is the minimum unit, the number of passes increases more than necessary so that in Step ST310, the printing areas are grouped in the main scanning direction. At this time, it is configured in a plurality of groups so as to maintain that the required ejection amount does not exceed the restricted ejection amount in each of the groups.

FIG. 8 is an explanatory diagram showing the configuration of the groups so as to maintain that the required ejection amount does not exceed the restricted ejection amount in each of the groups.

In one printing area shown in the drawing, hypothetically, there are three printing regions shown by oblique lines. Hypothetically, when the solid printing is totally performed in each of the printing regions, each region is 20% with respect to the whole area so that the required ink amount becomes 60%. However, the restricted ejection amount becomes 50% in this area based on the residual ink amount.

Then, a process that searches a divided position of the groups in a direction from the left end to the right end of the printing area is performed. At the point ending the first printing region, the accumulated value of the required ink amount is 20% and it compares with 50% of the restricted ejection amount. It does not exceed the restricted ejection amount so that the divided position is temporary set in the 20% position from the left end of the printing area. The area from 20% to 30% is the non-printing region. The printing region starts at the 30% position, and the 50% position is the next non-printing region. The accumulated value of the required ink amount at this point is 40%, but it does not exceed 50% of the restricted ejection amount so that the divided position is temporary set again in the 50% position from the left end of the printing area.

Next, the position from 50% to 80% is the non-printing region, and the next printing region is the position from 80% to 100%. When the accumulated value of the required ink amount is determined in the 100% position where the printing region ends, the accumulated value of the required ink amount is 60% so that it exceeds 50% of the restricted ejection amount. In this condition, the 50% position as the aforementioned temporary divided position is set as a formal divided position, and the configuration of the first group ends. Then, as the residual amount of the number of passes, "1" is deducted from the initially set number of passes.

The residual amount of the number of passes is set in such process, and after that, if the residual amount of the number of passes exceeds "1", the process setting a temporary divided position is repeated in the same manner. In the case that the residual amount of the number of passes is "1", even if all of the remains are configured as one group, the required ink amount does not exceed the restricted ejection amount so that the grouping process ends.

In Step ST312, the raster data is generated again in each group based on the position information when the grouping was performed. That is, it only maintains the ink ejection information of the printing regions, and the ink ejection information of other regions is turned off. As an example shown in FIG. 8, the first group only maintains the information of the 0 to 20% printing region and the 30% to 50% printing region, and the second group only maintains the information of the 80% to 100% printing region.

Taking these results, in Step ST314, the printing region of 0% to 20% and the printing region of 30% and 50% are only printed in the going stroke of the pass started from the left end and the print head 18 reaches to the right end. The printing region of 80% to 100% is only printed in the returning stroke of the pass started from the right end and the print head 18 reaches to the left end. That is, the printing divided into two in the main scanning direction is completed in the two times of passes.

As described above, Step ST308 corresponds to the process to determine whether or not there is a region that is possible to be divided in the printing area of one bandwidth in the main scanning direction as a standard based on the print data of the bandwidth. Step ST310 corresponds to the division of the printing area that does not exceed the aforementioned ejectable amount by using the area that is possible to be divided.

Further, by Step ST312 and Step ST314, the printing area is printed in each one of divisions in each of the plural times of the main scanning operations.

In this sense, Step ST308 to Step ST314 correspond to that the printing area is divided not to exceed the aforementioned ejectable amount as a standard in the main scanning direction based on the print data of the aforementioned bandwidth, and the one division of the printing area is printed by each of the plural times of the main scanning operations so that it can be said that the division printing control part is provided.

In the present embodiment, the printing regions that are grouped are adjacent to each other, but it is not required to group the regions adjacent to each other. In the example shown in FIG. 8, the 0% to 20% printing region and the 80% to 100% printing region may be one of the groups, and only the 30% to 50% printing region may be the other one of the groups. It is possible to organize the group that does not exceed almost to the limit of the restricted ejection amount by grouping as such skipping regions so that it is possible to prevent the number of passes from increasing unexpectedly depending on the conditions.

In such aforementioned embodiment, based on the raster data generated in response to the printing area for one bandwidth, the required ink amount that is necessary for the same printing area was determined (Step ST202), and the restricted ejection amount was determined based on the residual ink amount at this point (Step ST204). When the required ink amount exceeded the restricted ejection amount, the number of passes for the division printing that does not exceed the restricted ejection amount in one pass was determined (Step ST206), and the printing regions were divided in the sub-scanning direction or the main scanning direction in response to the determined number of passes, and the division printing that divides it into the plural times was performed (Step ST208 to Step ST212, Step ST308 to Step ST314).

Because of this, there is the case that the division printing is performed depending on the print amount of the printing area, and in this case, the efficiency of the printing becomes excellent in comparison with the case that the division printing is always performed when the residual ink amount is low.

Above, it was described as the printing device in which the ink was used, but the concept of the printing is not limited to the case that letters or patterns are drawn to a paper by using the ink. The print medium may be targeted to various types such as the most basic paper, a resin sheet, a metal sheet, a surface of a solid body, etc. Also, the ink is not limited to the color expression, and various types of liquids may be included to be ejected for an application of any functions. Accordingly, in the present invention, the printing device has the same meaning as various types of liquid ejection devices, and also, the ink has the same meaning as various types of various types of droplets.

In the aforementioned embodiment, the configuration and the function were mainly described as the printing device, but the configuration and the function are described as the printing method by disclosing the procedure of the function.

By the way, it is needless to say that the present invention is not limited to the aforementioned embodiment. As for a parson skilled in the art, needless to say, the combination of the mutually replaceable members and configurations, etc. disclosed in the aforementioned embodiment may be appropriately modified. Also, it was not disclosed in the aforementioned embodiment, but the mutually replaceable members and configurations, etc. may be appropriately replaced with the members and configurations, etc. that were known technologies and were disclosed in the aforementioned embodiment, and its combination may be modified and applied. Also, it was not disclosed in the aforementioned embodiment, but based on the known technologies, etc., a parson skilled in the art may appropriately replace members and configurations, etc. that may be presumed as the substitution of the members and configurations, etc. disclosed in the aforementioned embodiment, and its combination may be modified and applied. They are disclosed as an embodiment of the present invention.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A printing device having a print head configured and arranged to eject ink supplied from an ink cartridge, the print head being reciprocally drivable in a main scanning direction, which intersects a paper feed direction, with respect to a print medium, and the print medium being sequentially drivable in a sub-scanning direction, which is the paper feed direction, the printing device comprising:

a required ink amount acquisition part configured to determine a required ink amount based on print data of a bandwidth over which the ink is ejected by driving the ink head in the main scanning direction, the required ink amount acquisition part being further configured to determine the required ink amount in total areas of a printing region where the ink is ejected and a non-printing region where the ink is not ejected;

an ejectable amount acquisition part configured to determine an ejectable amount based on a residual amount in the ink cartridge; and a division printing control part configured to determine whether a printing for the bandwidth is performed by one time of a main scanning operation, or the printing is performed by dividing into multiple main scanning operations based on the required ink amount and the ejectable amount, and to perform the printing in accordance with the determination.

2. The printing device according to claim 1, wherein the ejectable amount acquisition part is configured to determine the ejectable amount that is an amount to be able to eject the ink in one time of the main scanning operation based on the residual amount of the ink cartridge, and the division printing control part is configured to perform the printing for the bandwidth by dividing into the multiple main scanning operations when the required ink amount exceeds the ejectable amount in one time of the main scanning operation.

3. The printing device according to claim 1, wherein the division printing control part is configured to divide a nozzle array of the print head in the sub-scanning direction in response to numbers of required main scanning operations for the printing of the bandwidth, and each divided portion of the nozzle array is used in each of the main scanning operations.

4. The printing device according to claim 1, wherein the division printing control part is configured to divide a printing area so as not to exceed the ejectable amount in the main scanning direction based on the print data of the bandwidth, and to perform the printing for each division of the printing area in each of the multiple main scanning operations.

5. The printing device according to claim 4, wherein the division printing control part is configured to determine whether or not there is a dividable area in the printing area in the main scanning direction based on the print data of the bandwidth, and to divide the printing area so as not to exceed the ejectable amount in the dividable area, and to perform the printing for each division of the printing area in each of the multiple main scanning operations.

6. The printing device according to claim 1, wherein the ejectable amount acquisition part has tabular data that compares between the residual amount of the ink cartridge and the ejectable amount.

7. The printing device according to claim 1, wherein the ejectable amount acquisition part is configured to perform calculation to determine the ejectable amount from the residual amount of the ink cartridge.

8. A printing method performed by a printing device having a print head configured and arranged to eject ink supplied from an ink cartridge, the print head being reciprocally drivable in a main scanning direction, which intersects a paper feed direction, with respect to a print medium, and the print medium being sequentially drivable in a sub-scanning direction, which is the paper feed direction, the printing method comprising:

determining a required ink amount based on print data of a bandwidth in which the ink is ejected by driving the ink head in the main scanning direction, the required ink amount being determined in total areas of a printing region where the ink is ejected and a non-printing region where the ink is not ejected;

determining an ejectable amount based on a residual amount in the ink cartridge; and determining whether a printing for the bandwidth is performed by one time of a main scanning operation, or the printing is performed by dividing into multiple main scanning operations based on the required ink amount and the ejectable amount, and performing the printing in accordance with the determination.

* * * * *